US012042849B2

(12) United States Patent
Sallot

(10) Patent No.: US 12,042,849 B2
(45) Date of Patent: Jul. 23, 2024

(54) CASTING RING FOR OBTAINING A PRODUCT MADE OF TITANIUM ALLOY OR A TITANIUM-ALUMINUM INTERMETALLIC ALLOY AND METHOD USING SAME

(71) Applicant: SAFRAN, Paris (FR)

(72) Inventor: Pierre Jean Sallot, Moissy-Cramayel (FR)

(73) Assignee: Safran, Paris (FR)

( * ) Notice: Subject to any disclaimer, the term of this patent is extended or adjusted under 35 U.S.C. 154(b) by 0 days.

(21) Appl. No.: 18/255,805

(22) PCT Filed: Dec. 2, 2021

(86) PCT No.: PCT/FR2021/052183

§ 371 (c)(1),
(2) Date: Jun. 2, 2023

(87) PCT Pub. No.: WO2022/117965

PCT Pub. Date: Jun. 9, 2022

(65) Prior Publication Data

US 2023/0415224 A1 Dec. 28, 2023

(30) Foreign Application Priority Data

Dec. 3, 2020 (FR) ..... 2012626

(51) Int. Cl.
*B22D 11/041* (2006.01)
*B22D 7/06* (2006.01)
(Continued)

(52) U.S. Cl.
CPC ..... *B22D 11/041* (2013.01); *B22D 7/06* (2013.01); *B22D 11/001* (2013.01); *B22D 11/059* (2013.01)

(58) Field of Classification Search
CPC ... B22D 11/041; B22D 11/001; B22D 11/059; B22D 11/055; B22D 7/06; B22D 7/068; B22D 15/00; B22D 27/045
See application file for complete search history.

(56) References Cited

U.S. PATENT DOCUMENTS

2006/0070716 A1 4/2006 Nippert et al.
2009/0008059 A1 1/2009 Jacques et al.

FOREIGN PATENT DOCUMENTS

JP H03052747 A 3/1991

OTHER PUBLICATIONS

France Search Report and Written Opinion mailed Jun. 9, 2021, issued in Application No. FR2012626, filed Dec. 3, 2020, 7 pages.
(Continued)

*Primary Examiner* — Kevin P Kerns
*Assistant Examiner* — Steven S Ha
(74) *Attorney, Agent, or Firm* — Christensen O'Connor Johnson Kindness PLLC

(57) ABSTRACT

A casting ring having a first section made of a heat-conductive material and a second section made of a MAX phase alloy material, and a method for obtaining a product made of titanium alloy or a titanium-aluminum intermetallic compound by plasma torch melting, the alloy having an oriented structure, the method including heating the molten alloy surface in the casting ring with a plasma torch; cooling a cold zone of the casting ring over a length L1, the cooling forming a semi-solid crown of alloy; heating a hot zone of the casting ring over a length L2, thereby forming a solidification front, the flatness of which relative to a plane perpendicular to a drawing direction is less than 10°; and drawing the solidified alloy at a speed of more than $10^{-4}$ m/s in the drawing direction.

9 Claims, 4 Drawing Sheets

(51) Int. Cl.
*B22D 11/00* (2006.01)
*B22D 11/059* (2006.01)

(56) References Cited

OTHER PUBLICATIONS

International Search Report mailed Mar. 29, 2022, issued in corresponding International Application No. PCT/FR2021/052183, filed Dec. 2, 2021, 5 pages.
Written Opinion mailed Mar. 29, 2022, issued in corresponding International Application No. PCT/FR2021/052183, filed Dec. 2, 2021, 6 pages.

CASTING RING FOR OBTAINING A PRODUCT MADE OF TITANIUM ALLOY OR A TITANIUM-ALUMINUM INTERMETALLIC ALLOY AND METHOD USING SAME

TECHNICAL FIELD

The present invention relates to the field of alloy production, in particular aeronautical alloys like titanium-based alloys or TiAl intermetallics, in particular casting rings used to obtain ingots and methods using such casting rings.

PRIOR ART

The production of alloys, in particular by ingot drawing, mainly consists in heating a raw material in a crucible to melt it and in pouring it into a casting ring which will confer its shape on the ingot.

In general, casting rings are partly made of copper and may be water cooled. Copper is used because of its high thermal conductivity allowing good heat exchange, but also because of its good ductility facilitating use thereof while limiting the risk of break-up of this critical part. Thus, copper is particularly suitable for making the areas of the casting ring, called cold areas, which need to be cooled.

As regards the areas to be heated, called hot areas, foundry ceramics, such as alumina, yttria, zirconia or derivatives and composites thereof, are generally the most suitable for the manufacture of alloys.

Unfortunately, these materials have drawbacks for the manufacture of titanium-based alloys or TiAl intermetallic alloys. Indeed, these alloys in the molten state strongly react with the foundry ceramics, leading to the erosion of the casting ring and the incorporation into the alloy of solid ceramic inclusions torn from the wall of the casting ring. Still worse, since foundry ceramics are oxides, the oxygen they contain contaminates the alloys and weakens them.

Moreover, since foundry ceramics are not thermally conductive, the use of an external electrical resistance is necessary. If induction heating is desired, an additional susceptor surrounding the casting ring is required to avoid direct coupling with the alloy under solidification in the casting ring. Indeed, such a coupling generates circulation vortices of the molten alloy, thereby destabilizing the solidification front.

Refractory metals are occasionally used to make the hot areas. However, the risk of chemical interactions between these and the titanium-based alloys or TiAl intermetallics is high. In particular, low melting point eutectics might form and lead to the formation of critical defects in these alloys.

Recently, aluminum nitride has been used for the manufacture of foundry crucibles which has proven to be promising. Nevertheless, this material is expensive.

SUMMARY

This disclosure improves the situation.

To this aim, the present invention provides a casting ring for molding an ingot made of a titanium-based alloy or a TiAl intermetallic alloy, made of a tube with a first end and a second end and comprising:

- a first section made of a heat-conductive material, and extending from the first end, in particular over a length L1 comprised between 0.065 and 0.09 m;
- a second section made of a MAX phase alloy material and extending from the first section, in particular over a length L2 comprised between 0.17 and 0.3 m;

wherein the MAX phase is selected from among: $Nb_4Al_1C_3$, $Nb_2AlC$, $Ti_2AlC$ and $Ti_2AlN$.

Thanks to the use of such a casting ring, there is no risk of contamination of the manufactured alloy because the elements making up the material of the casting ring are elements generally present in titanium-based alloys and TiAl intermetallic alloys. Hence, there is no risk that it be weakened by the inclusion of foreign elements, such as oxygen from foundry ceramics. Moreover, such a casting ring has a good resistance to thermal shock and a low thermal expansion.

Other optional and non-limiting features are described hereinafter.

The heat-conductive material may be copper.

The inner surface of the tube at the second section may be covered with one or more layer(s), each of the layers being made of a material selected from among: $Nb_4Al_1C_3$, $Nb_2AlC$, $Ti_2AlC$, $Ti_2AlN$ and AlN.

When the material is $Nb_4Al_1C_3$, the inner surface of the tube at the second section may be covered, from the outside inwards, with:

- one single layer of $Nb_2AlC$;
- a first layer of $Nb_2AlC$ and a second layer of $Ti_2AlC$;
- a first layer of $Nb_2AlC$, a second layer of $Ti_2AlC$ and a third layer of AlN; or
- a first layer of $Nb_2AlC$, a second layer of $Ti_2AlC$, a third layer of $Ti_2AlN$ and a fourth layer of AlN.

When the material is $Nb_2AlC$, the inner surface of the tube at the second section may be covered, from the outside inwards, with:

- one single layer of $Ti_2AlC$;
- a first layer of $Ti_2AlC$ and a second layer of AlN; or
- a first layer of $Ti_2AlC$, a second layer of $Ti_2AlN$ and a third layer of AlN.

When the material is $Ti_2AlC$, the inner surface of the tube at the second section may be covered, from the outside inwards, with:

- one single layer of AlN; or
- a first layer of $Ti_2AlN$ and a second layer of AlN.

The first section and the second section may be connected to each other by a junction made by mechanical assembly or welding.

The casting ring may further comprise a third section extending from the second section up to the second end, in particular over a length of at least 0.03 m, and made of a heat-conductive material.

The casting ring may further comprise an annular flange extending from the first end perpendicularly to the extension of the first section and outwards.

In another aspect, the present invention relates to a method for obtaining a product made of a titanium alloy or a TiAl intermetallic alloy by plasma torch melting, the alloy having an oriented structure.

The method comprises:

- selecting a casting ring as described hereinabove, wherein length L1 is comprised between 0.065 and 0.09 m and length L2 between 0.17 and 0.3 m, and the thickness e1 and e2 of the first and second sections is selected according to the inequations Math. 1 and Math. 2 below, where R is the inner radius of the casting ring, ΔT1 is the desired maximum thermal gradient in the first section, ΔT2 is the desired maximum thermal gradient in the second section, A1 is equal to 9° C.·m and A2 to 60° C.·m, $L1_{min}$ is equal to 0.065 m, $L1_{max}$ to 0.09 m, $L2_{min}$ to 0.17 m, and $L2_{max}$ to 0.3 m;
- heating the surface of the molten alloy at the casting ring;

cooling the first section of the casting ring thereby forming a cold area, cooling forming a semi-solid crown of alloy;

heating the second section of the casting ring thereby forming a hot area and thus generating an alloy solidification front in this hot area and the flatness of which, with respect to a plane perpendicular to a drawing direction, is less than 10°; and drawing the solidified alloy at a speed higher than $10^{-4}$ m/s along a drawing direction.

$$R\left(\exp\left(\frac{L1_{min}\Delta T1}{A1}\right)-1\right) \le e1 \le R\left(\exp\left(\frac{L1_{max}\Delta T1}{A1}\right)-1\right) \quad \text{[Math. 1]}$$

$$R\left(\exp\left(\frac{L2_{min}\Delta T2}{A2}\right)-1\right) \le e2 \le R\left(\exp\left(\frac{L2_{max}\Delta T2}{A2}\right)-1\right) \quad \text{[Math. 2]}$$

BRIEF DESCRIPTION OF THE DRAWINGS

Other features, details and advantages will appear upon reading the detailed description hereinafter, and upon analyzing the appended drawings, wherein:

In FIGS. 4 to 7 hereinabove, the lines are isopleth lines joining points with the same angular value. The continuous line indicates the limit between the domain where angle α is larger than 100 and the domain where it is smaller than 10°. The darker the pattern, the larger the angle is.

DISCLOSURE

Figure 2:
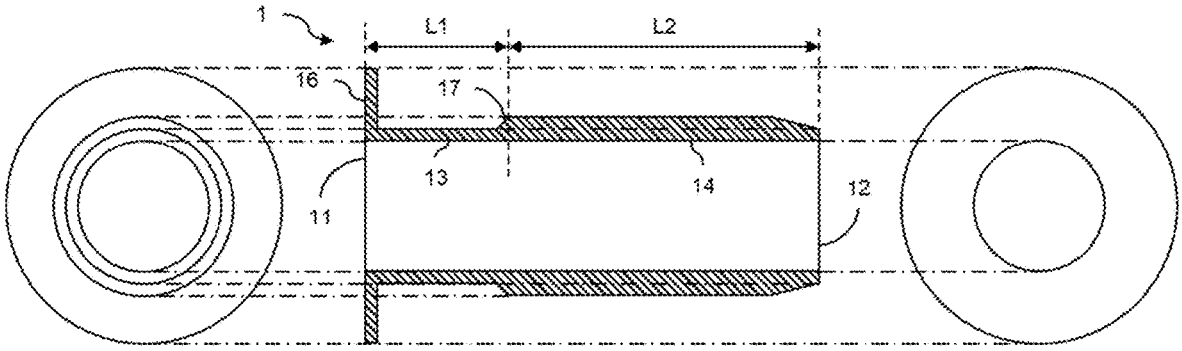
FIG. 2 illustrates a casting ring according to the invention with a cold area and a hot area.
Figure 3:
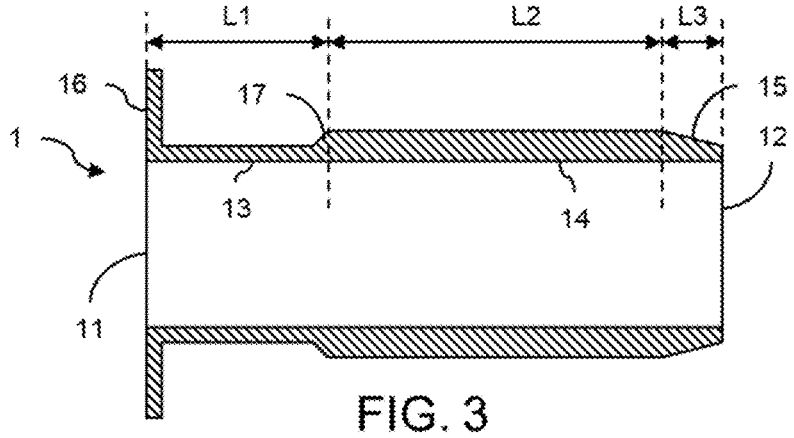
FIG. 3 illustrates a casting ring according to the invention with a cold area, a hot area and a second cold area.
Figure 4:
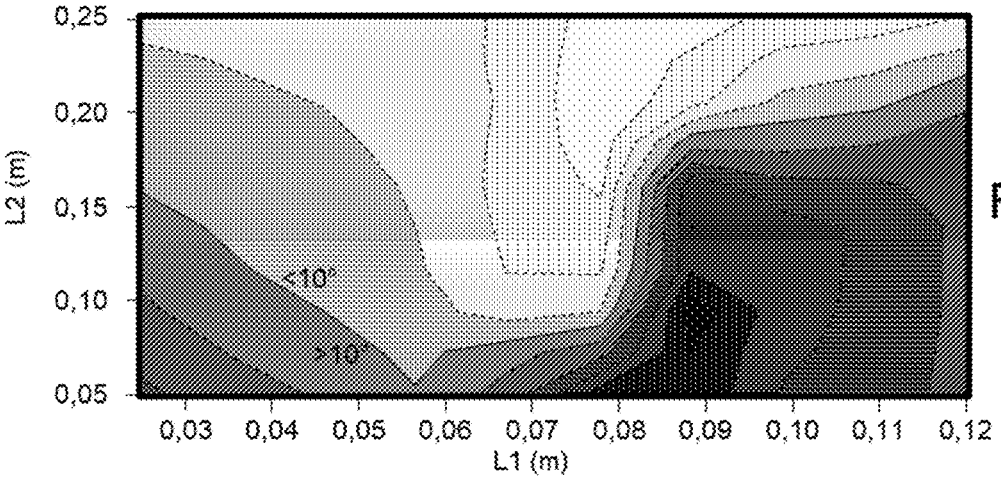
FIG. 4 shows angle α formed by the solidification front with respect to a plane perpendicular to the drawing direction as a function of the length of the cold area L1 and the length of the hot area L2 at a drawing speed of 0.00015 m/s.
Figure 5:
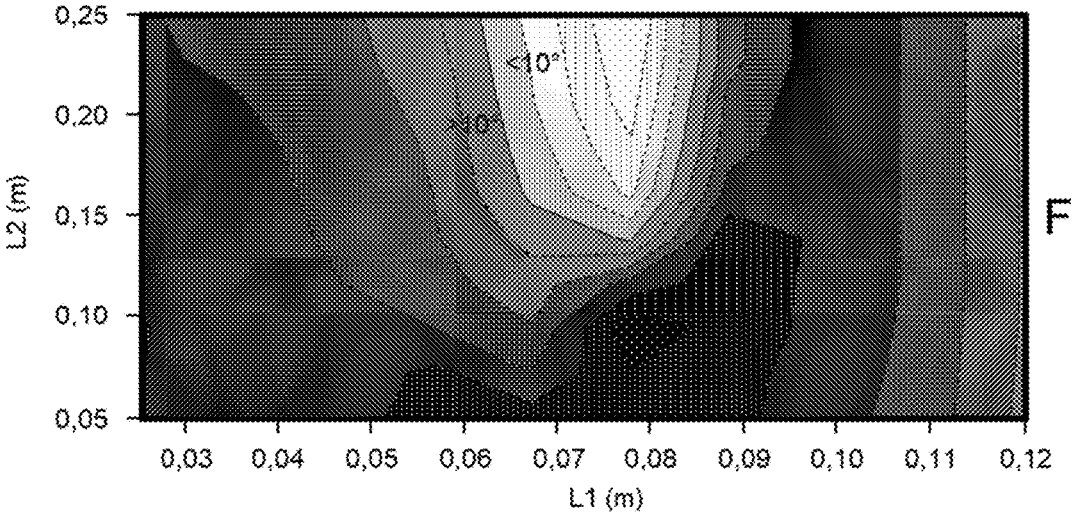
FIG. 5 shows angle α formed by the solidification front with respect to a plane perpendicular to the drawing direction as a function of the length of the cold area L1 and the length of the hot area L2 at a drawing speed of 0.0003 m/s.
Figure 6:
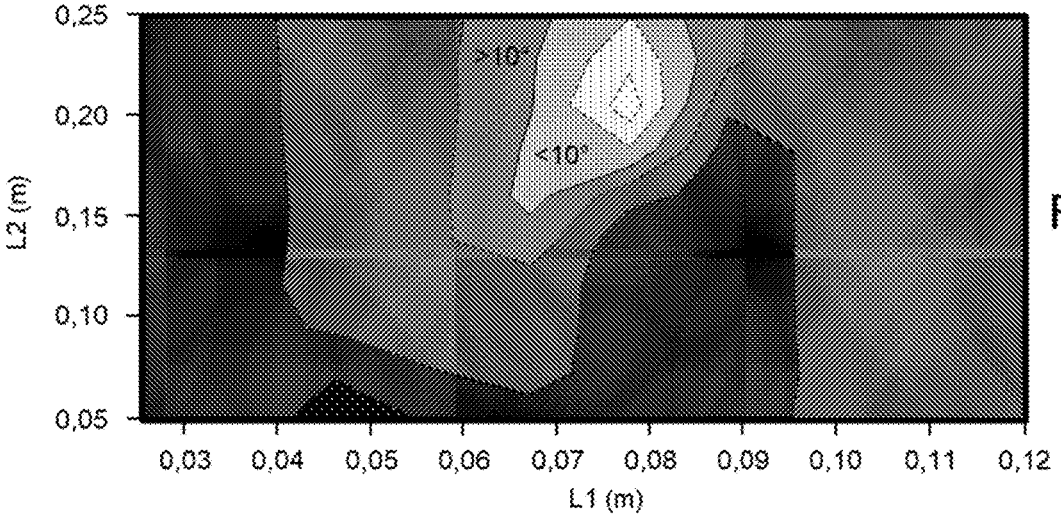
FIG. 6 shows angle α formed by the solidification front with respect to a plane perpendicular to the drawing direction as a function of the length of the cold area L1 and the length of the hot area L2 at a drawing speed of 0.00045 m/s.
Figure 7:
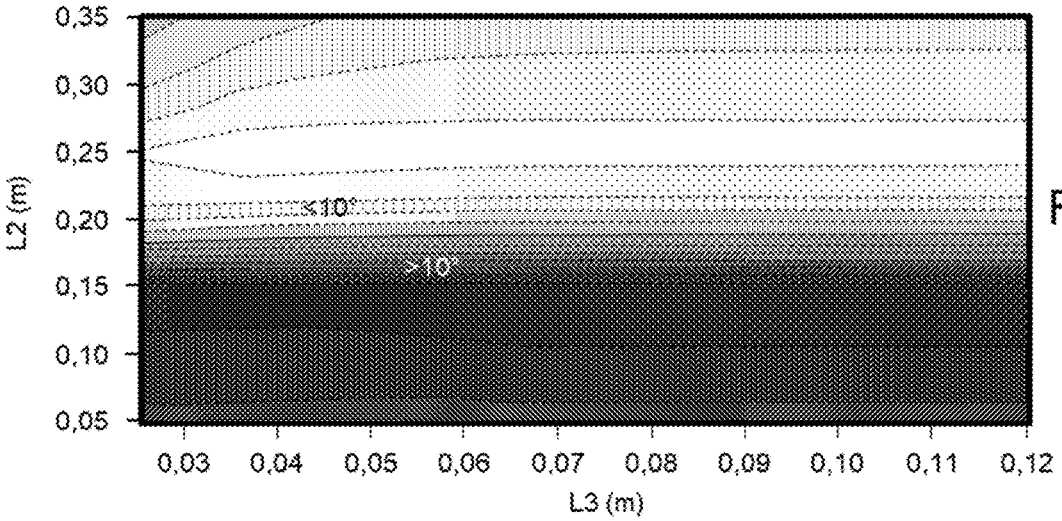
FIG. 7 shows angle α formed by the solidification front with respect to a plane perpendicular to the drawing direction as a function of the length of the hot area L2 and the length of the cold area L3 at a drawing speed of 0.0003 m/s, for a cold area length L1 of about 0.077 m.

A casting ring according to the present invention is described hereafter with reference to FIG. 2 and FIG. 3. Such a casting ring 1 is particularly suitable for molding an ingot made of a titanium-based alloy or a TiAl intermetallic alloy, made of a tube with a first end 11 and a second end 12.

The casting ring 1 comprises a first tube section 13 and a second tube section 14. The first section 13 is made of a heat-conductive material, and extends from the first end 11, in particular over a length L1 comprised between 0.065 and 0.09 m. The second section 14 is made of a MAX phase alloy and extends from the first section 13, in particular over a length L2 comprised between 0.17 and 0.3 m; the MAX phase being selected from among: $Nb_4Al_1C_3$, $Nb_2AlC$, $Ti_2AlC$ and $Ti_2AlN$. These MAX phases are the most compatible phases with the compositions of titanium-based alloys and TiAl intermetallic alloys. Indeed, besides titanium and aluminum elements, such alloys comprise other elements, the most commonly used of which are zirconium, molybdenum, niobium, chromium, tungsten, vanadium, carbon and boron. Thus, all the selected MAX phases have aluminum at site A. Moreover, these selected MAX phases are compatible with a temperature specific to the melting temperatures of titanium-based alloys and TiAl intermetallic alloys which are close to 1,500° C.

The casting ring 1 may further comprise a third section 15 extending from the second section 14 up to the second end 12, in particular over a length L3 of at least 0.03 m, and made of a heat-conductive material.

Lengths L1, L2 and L3 have been determined through simulation in particular with the aim to obtain a solidification front perpendicular to the drawing direction, i.e. to the longitudinal axis of the casting ring 1. The results of these simulations are shown in FIGS. 3 to 6. These figures show the impact of the selection of lengths L1 and L2 on the flatness of the solidification front at different drawing speeds, respectively 0.00015 m/s, 0.0003 m/s and 0.00045 m/s. The flatter the solidification front, the lighter the corresponding domain is. It can be noticed that the higher the drawing speed is, the smaller the domain corresponding to a solidification front forming an angle less than 100 with respect to a plane perpendicular to the drawing direction. The angle is measured at the inner surface of the casting ring in a plane comprising the longitudinal axis of the drawn ingot which is collinear with the drawing direction; this angle is between a line resulting from the intersection between the considered plane and the plane perpendicular to the drawing axis and a line tangent to the curve resulting from the intersection between the considered plane and the solidification front considered at the inner surface of the casting ring. The length intervals have been defined in order to have a good compromise between the flatness of the solidification front and the range of drawing speeds over which the method is applicable. When length L1 and length L2 are within the aforementioned intervals, the angle is less than 100 for a wide range of drawing speeds.

The first section 13 is a cold area and serves in particular as a heat exchange surface between the alloy which has been poured into the casting ring and a heat-transfer fluid circuit, making it possible to maintain the temperature of the alloy at about 25° C. at this area. Preferably, the heat-conductive material is copper, a material that has a high thermal conductivity while being ductile.

The second section 14 is a hot area, i.e. an area which is heated to remelt the alloy at this area, thereby making it possible to obtain the flattest possible solidification front, in particular with an angle less than 10°.

For alloys containing niobium and aluminum, the phases $Nb_4AlC_3$ and $Nb_2AlC$ may be used alone. In other cases, the inner surface of the tube at the second section is preferably covered with one or more layer(s), each of the layers being made of a material selected from among: $Nb_4AlC_3$, $Nb_2AlC$, $Ti_2AlC$, $Ti_2AlN$ and AlN.

For example, when the material is $Nb_4Al_1C_3$, the inner surface of the tube at the second section 14 is covered, from the outside inwards, with:

one single layer of $Nb_2AlC$;

a first layer of $Nb_2AlC$ and a second layer of $Ti_2AlC$;

a first layer of $Nb_2AlC$, a second layer of $Ti_2AlC$ and a third layer of AlN; or a first layer of $Nb_2AlC$, a second layer of $Ti_2AlC$, a third layer of $Ti_2AlN$ and a fourth layer of AlN.

In another example, the material is $Nb_2AlC$, the inner surface of the tube at the second section 14 is covered, from the outside inwards, with:

one single layer of $Ti_2AlC$;

a first layer of $Ti_2AlC$ and a second layer of AlN; or a first layer of $Ti_2AlC$, a second layer of $Ti_2AlN$ and a third layer of AlN.

Still in another example, the material is $Ti_2AlC$, the inner surface of the tube at the second section 14 is covered, from the outside inwards, with:

one single layer of AlN; or a first layer of $Ti_2AlN$ and a second layer of AlN.

The orders of layers mentioned above are important. Indeed, they make it possible to avoid formation of secondary phases at the interfaces between the different layers; the existence of a continuous solid solution being recommended between these phases.

The configurations having AlN in the innermost layer are particularly suitable for drawing alloys free of aluminum and having melting temperatures higher than 1,600° C.

Preferably, the layers have a thickness comprised between 50 μm and 1,000 μm. For example: 60 μm, 70 μm, 80 μm, 90 μm, 100 μm, 250 μm, 500 μm, or 750 μm.

Moreover, the selection of the above-mentioned materials also has the advantage of facilitating the manufacture of the casting ring. Indeed, all these materials are nowadays available in powder form. Thus, to make the casting ring, the different selected powders can be densified or deposited in the form of layers. The temperatures necessary to densify these different materials are relatively close, between 1,400 and 1,700° C., which can make it possible in particular to sinter them together. In any case, the following method could be implemented: the different materials are positioned concentrically in a mold enabling high-temperature sintering of powders. In the case where thin thicknesses are required (i.e. less than 250 μm), the cold spray process could be used to create the necessary layers on the inner surface of the casting ring. For cases involving AlN, and if a thin thickness (i.e. less than 250 μm) is necessary, the high-power impulse magnetron sputtering process (also called HiPIMS) could be implemented on the inner face of the casting ring.

As regards co-sintering, the spark plasma sintering process may be used, for example by applying the following densification cycle:

maximum sintering temperature: 1,500-1,600° C.;

hold time: 10-30 min;

applied pressure: 30-100 MPa;

atmosphere: vacuum.

An additional layer not in contact with the molten alloy may be added in the casting ring, for example over the outer surface, but generally at any area with the only limitation that it should not be in contact with the molten alloy. This additional layer consists of a ferromagnetic material, in particular a ferromagnetic alloy. This additional layer makes it possible to promote magnetic coupling with the casting ring. Examples of materials for such a layer are: pure iron, FeCo or FeSi alloys, etc. Preferably, the additional layer has a thickness of at least 250 μm, for example 300 μm, 350 μm, 400 μm, 450 μm, 500 μm. This additional layer may be obtained by thermal spraying or cold spraying.$$

The first section 13 and the second section 14 may be connected to each other through a junction 17 made by mechanical assembling or welding. Preferably, the junction 17 is included in the cold area of the casting ring. Indeed, this avoids limiting the assembling techniques but also taking advantage of the ductility of copper to limit the bending stresses in the stacks of MAX phase layers.

The third section 15, when provided, is a cold area for cooling the alloy.

The second end 12 of the casting ring may have a chamfer facilitating the insertion of the casting ring in the plant for obtaining the alloy ingot by drawing. When the third section 15 is provided, the chamfer may be made in the third section 15, in particular to completely cover the third section 15.

The casting ring 1 may further comprise an annular flange 16 extending from the first end 11 perpendicularly to the extension of the first section 13 and outwards. Preferably, the collar 16 is circular, but not necessarily. It may have a square, rectangular or triangular shape, optionally with rounded corners.

The aperture within the casting ring gives its shape to the alloy ingot. Given that it must be possible for the ingot to be drawn from the first end towards the second end, the inner wall of the casting ring is a mathematical cylinder, i.e. a surface generated by generatrices parallel to each other around a closed curve and extending between the first and second ends 11, 12. Although the closed curve is preferably a circle (the drawn ingot is therefore a right cylinder with a circular base), the present invention is not limited to such a shape. In particular, the closed curve may be a square, a rectangle or a triangle. The corners may also be rounded.

Preferably, the thickness of the walls at the first section 13, the second section 14 and the third section 15 is chosen according to the maximum temperature gradient that the casting ring 1 must withstand between its inner surface in contact with the alloy and its outer surface. In particular, the thicknesses are chosen according to Math. 1 and Math. 2 hereinabove.

In general, the thickness e1 of the first section 13 is smaller than the thickness e2 of the section 14. Thus, a shoulder is formed between the first and second sections. Preferably, this shoulder is larger than 90° and preferably corresponds to the junction of the materials of the two sections.

Advantageously, the above-described casting ring 1 can be used in a method for obtaining a product made of a titanium alloy or a TiAl intermetallic alloy by plasma torch melting to obtain an alloy having an oriented structure.

Figure 1:
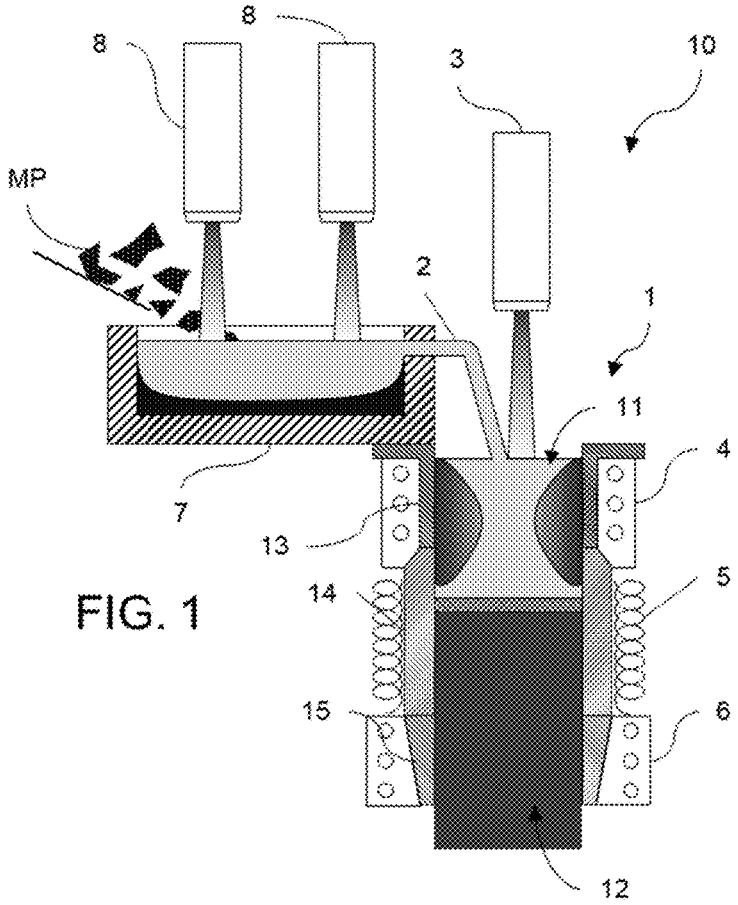
FIG. 1 shows a diagram illustrating the plasma torch melting process in a cold crucible using the casting ring according to the invention.

The method is schematically represented in FIG. 1 and comprises:

selecting a casting ring 1 as described above and with length L1 comprised between 0.065 and 0.09 m and length L2 between 0.17 and 0.3 m, and the thickness e1 and e2 of the first and second sections thereof is selected according to:

$$R\left(\exp\left(\frac{L1_{min}\Delta T1}{A1}\right)-1\right) \le e1 \le R\left(\exp\left(\frac{L1_{max}\Delta T1}{A1}\right)-1\right)$$

$$R\left(\exp\left(\frac{L2_{min}\Delta T2}{A2}\right)-1\right) \le e2 \le R\left(\exp\left(\frac{L2_{max}\Delta T2}{A2}\right)-1\right)$$

where R is the inner radius of the casting ring, ΔT1 is the desired maximum thermal gradient in the first section, ΔT2 is the desired maximum thermal gradient in the second section, A1 is equal to 9° C.·m and A2 to 60° C.·m, $L1_{min}$ is equal to 0.065 m, $L1_{max}$ to 0.09 m, $L2_{min}$ to 0.17 m, and $L2_{max}$ to 0.3 m:

heating the surface of the molten alloy at the casting ring, in particular by a plasma torch 3;

cooling the first section 13 of the casting ring 1 forming a cold area, in particular by cooling means 4, thereby forming a semi-solid crown of alloy;

heating, in particular by a heater 5, the second section 14 of the casting ring 1 forming a hot area thereby generating an alloy solidification front in this hot area and the flatness with respect to a plane perpendicular to a drawing direction of which is less than 10°; and drawing the solidified alloy at a speed higher than $10^{-4}$ m/s along a drawing direction.

The method may further comprise cooling the third section 15 of the casting ring forming a second cold area, in particular through a second cooling means 6.

Upstream of the above-described steps, the method may comprise providing a raw material MP (in particular in the form of offcuts, briquettes, bars, a sponge/master alloy mixture, etc.), heating the raw material MP (for example by plasma torch 8, by electric arcs, by induction, by electron bombardment, etc.) melting the raw material MP into a raw molten alloy, refining the molten raw alloy (comprising for example the stabilization the temperature of the alloy and the removal of impurities), and casting 2 the refined molten alloy into the casting ring 1. These steps are known from the prior art and do not constitute the core of the present invention.

The invention claimed is:

1. A casting ring configured for molding an ingot made of a titanium-based alloy or a TiAl intermetallic alloy wherein the casting ring is a tube having first and second ends, the casting ring comprising:

a first section made of a heat-conductive material and extending from the first end; and a second section made of a MAX phase alloy material and extending from the first section, wherein the MAX phase alloy material is selected from the group consisting of $Nb_4Al_1C_3$, $Nb_2AlC$, $Ti_2AlC$, and $Ti_2AlN$.

2. The casting ring of claim 1, wherein the heat-conductive material is copper.

3. The casting ring of claim 1, wherein an inner surface of the tube adjacent to the second section during molding is covered with one or more layers, each of the layers being made of a material selected from the group consisting of $Nb_4Al_1C_3$, $Nb_2AlC$, $Ti_2AlC$, $Ti_2AlN$ and AlN.

4. The casting ring of claim 3, wherein:

when the material of the one or more layers is $Nb_4Al_1C_3$, the inner surface of the tube adjacent to the second section during molding is covered, from an outer surface of the tube inwards, with:

one single layer of $Nb_2AlC$;

a first layer of $Nb_2AlC$ and a second layer of $Ti_2AlC$;

a first layer of $Nb_2AlC$, a second layer of $Ti_2AlC$ and a third layer of AlN; or a first layer of $Nb_2AlC$, a second layer of $Ti_2AlC$, a third layer of $Ti_2AlN$, and a fourth layer of AlN;

when the material of the one or more layers is $Nb_2AlC$, the inner surface of the tube adjacent to the second section during molding is covered, from the outer surface inwards, with:

one single layer of $Ti_2AlC$;

a first layer of $Ti_2AlC$ and a second layer of AlN; or a first layer of $Ti_2AlC$, a second layer of $Ti_2AlN$, and a third layer of AlN; and when the material of the one or more layers is $Ti_2AlC$, the inner surface of the tube adjacent to the second section during molding is covered, from the outer surface inwards, with:

one single layer of AlN; or a first layer of $Ti_2AlN$ and a second layer of AlN.

5. The casting ring of claim 1, wherein the tube further comprises an additional layer of a ferromagnetic material.

6. The casting ring of claim 1, wherein the first section and the second section are connected to each other by a junction made by mechanical assembly or welding.

7. The casting ring of claim 1, further comprising a third section extending a length of at least 0.03 m from the second section up to the second end of the tube during molding, the third section comprising a heat-conductive material.

8. The casting ring of claim 1, further comprising an annular flange extending from the first end of the tube perpendicular to the extension of the first section and outwards during molding.

9. A method for obtaining a product made of a titanium alloy or a TiAl intermetallic alloy by plasma torch melting, the alloy having an oriented structure, the method comprising:

selecting a casting ring according to claim 1, wherein a length L1 is from 0.065 m and 0.09 m, a length L2 is from 0.17 m and 0.3 m, and thicknesses e1 and e2 of the first and second sections is selected according to:

$$R\left(\exp\left(\frac{L1_{min}\Delta T1}{A1}\right)-1\right) \le e1 \le R\left(\exp\left(\frac{L1_{max}\Delta T1}{A1}\right)-1\right)$$

$$R\left(\exp\left(\frac{L2_{min}\Delta T2}{A2}\right)-1\right) \le e2 \le R\left(\exp\left(\frac{L2_{max}\Delta T2}{A2}\right)-1\right)$$

where R is the inner radius of the casting ring, ΔT1 is the desired maximum thermal gradient in the first section, ΔT2 is the desired maximum thermal gradient in the second section, A1 is equal to 9° C.-m and A2 to 60° C.-m, $L1_{min}$ is equal to 0.065 m, $L1_{max}$ to 0,09 m, $L2_{min}$ to 0.17 m, and $L2_{max}$ to 0.3 m:

heating a surface of the molten alloy at the casting ring;

cooling the first section of the casting ring thereby forming a cold area, the cooling forming a semi-solid crown of alloy;

heating the second section of the casting ring thereby forming a hot area and thus generating an alloy solidification front in this hot area and the flatness of which, with respect to a plane perpendicular to a drawing direction, is less than 10°; and drawing the solidified alloy at a speed higher than $10^{-4}$ m/s along a drawing direction.

* * * * *